US012722758B2

(12) United States Patent
Golden

(10) Patent No.: US 12,722,758 B2
(45) Date of Patent: Sep. 1, 2026

(54) BOAT LIFT BUNK WITH INTEGRAL T-SLOT

(71) Applicant: William Golden, North Fort Myers, FL (US)

(72) Inventor: William Golden, North Fort Myers, FL (US)

( * ) Notice: Subject to any disclaimer, the term of this patent is extended or adjusted under 35 U.S.C. 154(b) by 65 days.

(21) Appl. No.: 18/418,873

(22) Filed: Jan. 22, 2024

(65) Prior Publication Data

US 2024/0278884 A1 Aug. 22, 2024

Related U.S. Application Data

(60) Provisional application No. 63/441,638, filed on Jan. 27, 2023.

(51) Int. Cl.
*B63C 3/06* (2006.01)

(52) U.S. Cl.
CPC ..... *B63C 3/06* (2013.01)

(58) Field of Classification Search
CPC ..... B63C 3/06; B63C 3/00; B63C 3/12
See application file for complete search history.

(56) References Cited

U.S. PATENT DOCUMENTS 10,654,548 B2 * 5/2020 Hewitt ..... B63C 3/06
2020/0180495 A1 * 6/2020 Wheeler ..... B60P 3/1066

* cited by examiner

*Primary Examiner* — Sean D Andrish
(74) *Attorney, Agent, or Firm* — William E. Noonan

(57) ABSTRACT

A boat lift bunk includes elongate bottom and top walls and a pair of elongate first and second side walls that interconnect the bottom and top walls. The first side wall includes at least one longitudinal T-slot for receiving and retaining the head of a threaded connector such that a threaded post of the connector extends exteriorly of the first wall of the bunk for connecting the bunk to a cradle beam or other underlying supportive boat lift structure.

20 Claims, 5 Drawing Sheets

BOAT LIFT BUNK WITH INTEGRAL T-SLOT

RELATED APPLICATION

This application claims the benefit of U.S. Provisional Application Ser. No. 63/441,638 filed Jan. 27, 2023.

FIELD OF THE INVENTION

This invention relates to a boat lift bunk having an integral T-slot configuration for engaging and adjustably positioning connective elements such as bolts to secure the bunk to the cradle beams of the boat lift.

BACKGROUND OF THE INVENTION

Boat lifts commonly employ a substantially parallel pair of elongate bunks for supporting a boat on the lift. In winder driven cable lifts, the bunks are typically mounted across a pair of transverse cradle beams. Most conventional boat lift bunks comprise hollow aluminum beams having side walls that are approximately ⅛" thick. The bunk is normally secured proximate each end to a respective underlying cradle beam by a pair of L-shaped bunk brackets oriented vertically and positioned on respective sides of the cradle beam. Each bunk bracket is bolted to both the cradle beam and supported bunk.

The foregoing construction presents a number of problems. Proximate each end of each bunk, four pairs of aligned connector holes must be precisely formed through the opposing side walls of the hollow bunk for receiving respective 3-4" connector bolts. Two of these bolts are also inserted through corresponding connector holes formed in one of the bunk brackets and the other two bolts are inserted through corresponding connector holes formed in the other bracket. A fastening nut is threadably secured to each connector bolt to secure the bunk to the underlying cradle beam. Attaching the bunks to the cradle beams in this manner is tedious, time consuming, costly and labor intensive. Because two pairs of connector bolts are employed proximate each end of the bunk and two aligned holes must be cut in the bunk to accommodate each bolt, a total of sixteen connector holes must be formed through the side walls of each bunk. Thirty-two connector holes are therefore required for most conventional boat lifts employing two bunks. Each corresponding pair of such bunk connector holes must be accurately measured and cut to align with one another and with the corresponding connector hole in the bunk bracket. Not only does the process of forming these holes take considerable time and effort, if an error is made in measuring the proper position of one or more holes or if a connector hole is imprecisely cut, the operation must be repeated. The bunk may have to be replaced, additional undue cost may be incurred and material is apt be wasted.

Use of conventional 3-4" bolts according to the prior art also contributes to higher manufacturing costs. Such bolts typically cost in excess of three dollars apiece, which translates to one hundred dollars or more per lift for bunk bolts alone. This also adds to the cost of the finished lift to customers.

Workers installing bunks according to the conventional technique described above also must be extremely careful not to overtighten the connector bolts and corresponding fastening nuts. Such overtightening may cause the ⅛" thick aluminum walls of the bunk to collapse, in which case the bunk may have to be removed and replaced. This again wastes materials and adds to manufacturing and installation costs and delays. As a result of the foregoing difficulties, the conventional manner of installing and securing boat lift bunks has proven to be quite inconvenient, insufficient and unsatisfactory.

SUMMARY OF THE INVENTION

It is therefore an object of the present invention to provide a boat lift bunk having an integral T-slot configuration that enables the bunk to be more quickly, conveniently, efficiently and accurately installed in the boat lift.

It is a further object of this invention to provide a boat lift bunk employing a longitudinal T-slot configuration that eliminates the tedious, time consuming and labor intensive task of cutting numerous individual connector holes and permits the bunk to be conveniently adjusted and secured at a selected longitudinal position across the underlying cradle beams such that mounting and installation of the bunk is facilitated considerably.

It is a further object of this invention to provide a boat lift bunk featuring a longitudinal connector-accommodating T-slot that significantly reduces the time, tedium, effort and cost required to form connector holes in existing bunks and which reduces the material waste, time delays and extra cost involved when imprecise measurements are made or connector holes are inaccurately cut.

It is a further object of this invention to provide a connector T-slot configuration for a boat lift bunk that allows shorter and less expensive connector bolts to be effectively used to connect the bunk to the underlying boat lift.

It is a further object of this invention to provide an extruded aluminum boat lift bunk that does not use connector bolts that extend through opposing side walls of the bunk and therefore eliminates the risk of collapsing those walls due to overtightening.

This invention features a boat lift bunk that is mounted to an underlying pair of cradle beams or other supportive boat lift structure for supporting a boat or other marine vessel thereon. The bunk includes an elongate pair of opposing top and bottom walls and an elongate pair of first and second side walls that interconnect the top and bottom walls to define an interior space of the bunk. The first wall carries at least one longitudinal T-slot for slidably receiving and retaining the head of a threaded connector such that a threaded post of that connector extends exteriorly of the first wall of the bunk for connecting the bunk to the underlying supportive boat lift structure.

In a preferred embodiment, the first wall carries a parallel pair of longitudinal T-slots, each slot for receiving and slidably retaining a respective threaded connector. The T-slot may include an entry gap formed through the first wall and a connector retaining channel that is attached interiorly to the first wall. The retaining channel may be bounded by an interior channel wall that separates the retaining channel from the interior space of the bunk. The retaining channel communicates with and is laterally wider than the entry gap of the T-slot.

Preferably the boat lift bunk is securely interconnected to a pair of elongate cradle beams that are arranged laterally relative to the bunk. More particularly, the bunk is secured to an underlying cradle beam by a pair of vertical bunk brackets attached to opposite sides of the cradle beam. Preferably, the bunk includes a pair of longitudinal T-slots. Bolts or other threaded connectors are installed in each T-slot and positioned on respective sides of the underlying cradle beam. The threaded post of each bolt is then interengaged with a corresponding hole formed on a respective one of the vertical bunk brackets. A respective nut is attached to each bolt to secure the bunk to the opposing brackets. The bunk brackets preferably comprise L-brackets, each having a first leg that faces the first wall of the bunk and the T-slots(s) formed therein. A second bunk bracket leg is formed at a 90° angle to the first leg and faces a respective side of the cradle beam. Bolts may be connected between the respective second legs of the L-brackets and interengaged with the interposed cradle beam to secure the L-brackets to the underlying cradle beam.

BRIEF DESCRIPTION OF THE DRAWINGS

Other objects, features and advantages will occur from the following description of a preferred embodiment and the accompanying drawings, in which.

DETAILED DESCRIPTION OF THE INVENTION

Figure 1:
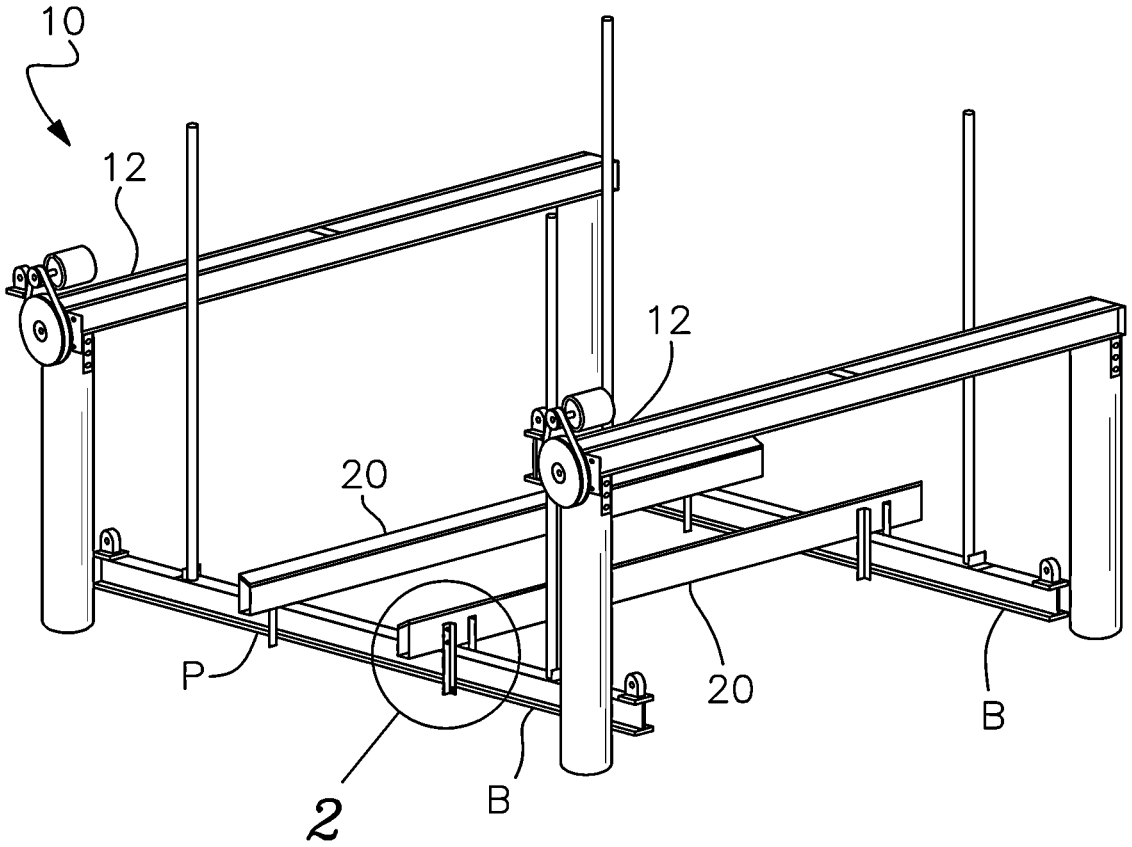
Fig. 1 (Prior Art)
FIG. 1 is a perspective view of a cable driven boat lift that employs conventional bunks.

There is shown in FIG. 1 a conventional cable driven boat lift 10 wherein motor driven winder assemblies 12 are employed to raise and lift a vessel (not shown) supported on a lift platform P. The lift cables that interconnect winder mechanism 12 and platform P are likewise omitted. Nonetheless, the construction and operation of such lifts will be known to persons skilled in the art.

Platform P includes a pair of lateral or transverse cradle beams B that are operably connected at their respective ends to the lifting cables. A substantially parallel pair of elongate bunks 20 extend longitudinally across and are attached to beams B. The vessel to be raised or lowered is supported on bunks 20. To raise the supported vessel, the winders 12 are driven in a first direction such that the cables lift cradle beams B and bunks 20. Operating the winders in the opposite direction directs the cables to lower the supported cradle beams and attached bunks. Again, this operation is conventional and will be understood by persons skilled in the art.

Figure 2:
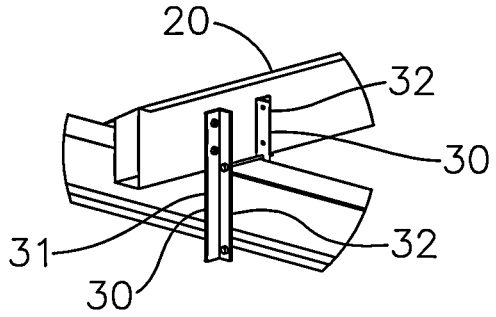
Fig. 2 (Prior Art)
FIG. 2 is an enlarged, fragmentary perspective view of the circled drawing portion designated by reference character 2 in FIG. 1, which reflects the prior manner of mounting a hollow boat lift bunk to an underlying cradle beam.
Figure 3:
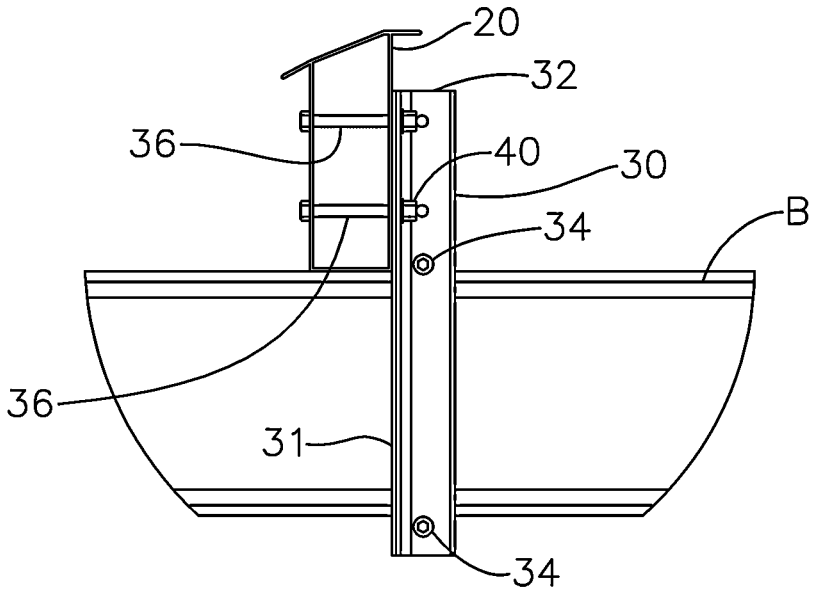
Fig. 3 (Prior Art)
FIG. 3 is an elevational end view of the known manner for attaching the bunk to the cradle beam of the boat lift wherein 3-4" bolts are installed through aligned holes cut in opposing walls of the hollow bunk and which are aligned with corresponding holes of a bunk bracket.

FIGS. 2 and 3 depict the manner in which each bunk B is conventionally secured to each underlying cradle beam B. In particular, each bunk 20 typically comprises a hollow aluminum beam composed of ⅛" thick aluminum. Each bunk 20 is secured proximate a respective end of the bunk to a corresponding underlying cradle beam B. In particular, a pair of bunk brackets 30 are employed proximate each end of each bunk 20 to fasten the bunk to a respective underlying cradle beam B. As represented in FIGS. 2 and 3, a first bunk bracket 30 is positioned and oriented vertically on one side of beam B and a second bunk bracket 30 is similarly positioned on the opposite side of the beam. The bunk brackets comprise L-shaped brackets having planar legs 31, 32 formed at 90° to one another. Leg 32 is engaged with one vertical side of beam B (typically against the flanges of the beam when an I-beam is employed). The leg 32 of the opposite bracket 30 similarly engages the opposite side of cradle beam B. Elongate threaded connectors, which may include carriage bolts or alternative threaded connectors 34, are interengaged between corresponding aligned connector holes in legs 32 of brackets 30 and a fastening nut is attached to each connector 34 and tightened such that connectors 34 are secured respectively above and below cradle beam B and opposing brackets 30 are, in turn, secured to bunk B in the manner shown. According to the prior art, two connector bolts 36 are employed to secure bunk 20 to each spaced apart bunk bracket 30. To properly mount the bunk, the installer must precisely measure and cut a pair of aligned holes in opposing side walls of aluminum bunk 20. Those holes must also match a corresponding connector hole formed in second leg 31 of bracket 30. Because each end of the bunk is engaged with a pair of brackets, a total of eight connecting holes must be located and formed proximate each end of the bunk. For a single boat lift employing a pair of bunks, a total of thirty-two such holes must be measured and cut. After the holes are precisely measured and cut, and bunk 20 is engaged with a cradle B and aligned with the corresponding connecting holes in leg 31 of bracket 30, 3-4 inch connecting bolts 36 are interengaged between the aligned holes in the opposing walls of the bunk and the corresponding hole in the bunk bracket. A nut 40 is then attached threadably to each bolt and tightened to secure the bunk to bracket 30 and underlying cradle beam B.

As previously described, the foregoing operation tends to be tedious, time consuming, labor intensive, unduly expensive and inefficient. Accurately cutting thirty-two holes per lift is especially inconvenient. If an incorrect measurement is taken or a hole is inaccurately cut, the process may have to be repeated and time and materials are apt to be wasted. In addition, the large 3-4" carriage bolts typically employed to secure the bunk to the bunk bracket tend to be quite expensive, which can add undesirable expense to manufacturing the lift, especially because so many bolts are required.

An additional problem with the prior art is that the bunks are apt to be damaged if the bolts 36 are overtightened. Bunks 20 typically employ ⅛" extruded aluminum and feature a hollow construction. If nut 40 is tightened too much on bolt 36, this can cause one or both walls of bunk 20 to collapse. In such cases the bunk will require replacement and materials and time are wasted. This also further adds to the cost of manufacturing the overall lift.

Figure 4:
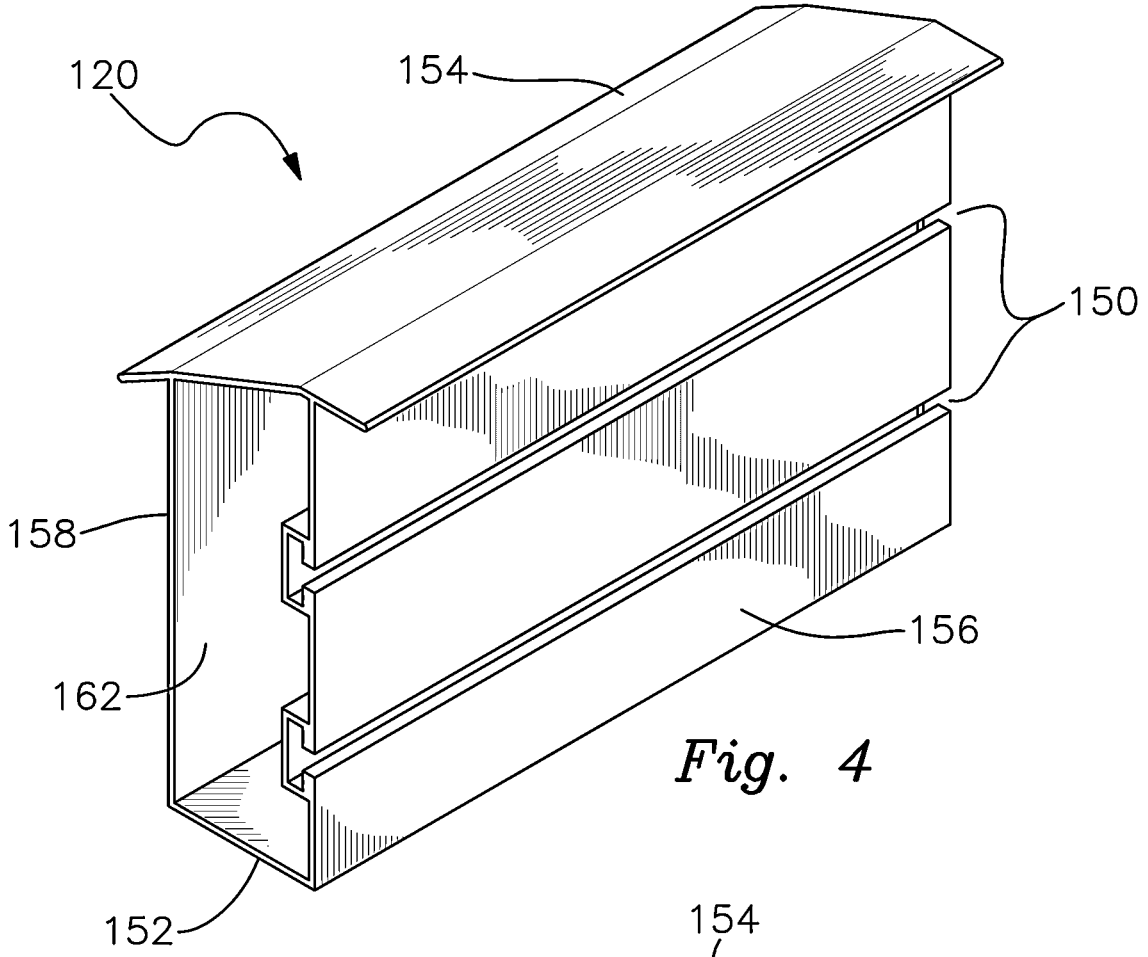
FIG. 4 is a perspective, fragmentary view of a bunk bracket having an integral pair of bolt retaining T-slots in accordance with this invention.
Figure 5:
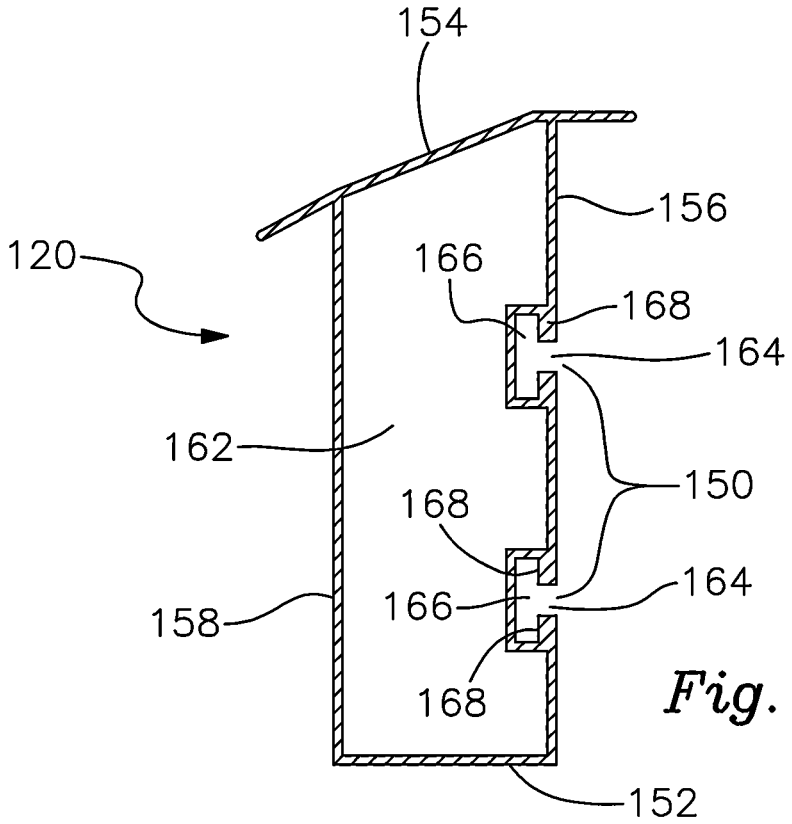
FIG. 5 is an elevational end view of the bunk with integral T-slots.

The foregoing problems are overcome by employing the bunk 120 shown in FIGS. 4 and 5. Bunk 120 is again typically composed of extruded aluminum. However, it uniquely employs a pair of integral T-slots 150, which address and overcome the shortcomings of conventional boat lift bunks. As used herein, "T-slot" should be understood to refer to a channel or slot in the bunk formed longitudinally in the bunk and having a generally T-shape cross-sectional configuration.

As depicted in FIGS. 4 and 5, bunk 120 includes an elongate bottom wall 152 and an elongate top wall 154. The top wall 154 may be angled or sloped as shown and may comprise an alternative single or multiple piece construction, as is known in the prior art. A cushion (not shown) may be mounted to top wall 154 to avoid undue scratching of the hull of the vessel being supported by the bunk. The precise shape and construction of the bottom wall and top wall may be varied and do not constitute limitations of this invention.

Bunk 120 further includes a first elongate side wall 156 and a second elongate side wall 158. Side walls 156 and 158 interconnect bottom wall 152 with top wall 154 of bunk 120. A fragmentary view of the bunk is shown in FIG. 4 and it should be understood that the bunk features a like construction for the entire length of the bunk. Bottom wall 152, top wall 154 and side walls 156, 158 surround and enclose an interior space 162 of bunk 120. First side wall 156 carries integral T-slots 150. Each T-slot 150 is formed to extend longitudinally through first wall 156 of bunk 120. In particular, each T-slot 150 includes an entry gap 164 formed through side wall 156 and a connector retaining channel 166 that is connected to side wall 156 and protrudes inwardly into the interior space 162 of the bunk. The connector retaining channel communicates with the entry gap and is laterally (i.e., vertically) wider than the entry gap. The channel forms a pair of opposing lips 168 above and below corresponding entry gap 164 for retaining the head of a bolt or other connector that is retained in the T-slot as described more fully blow.

Figure 6:
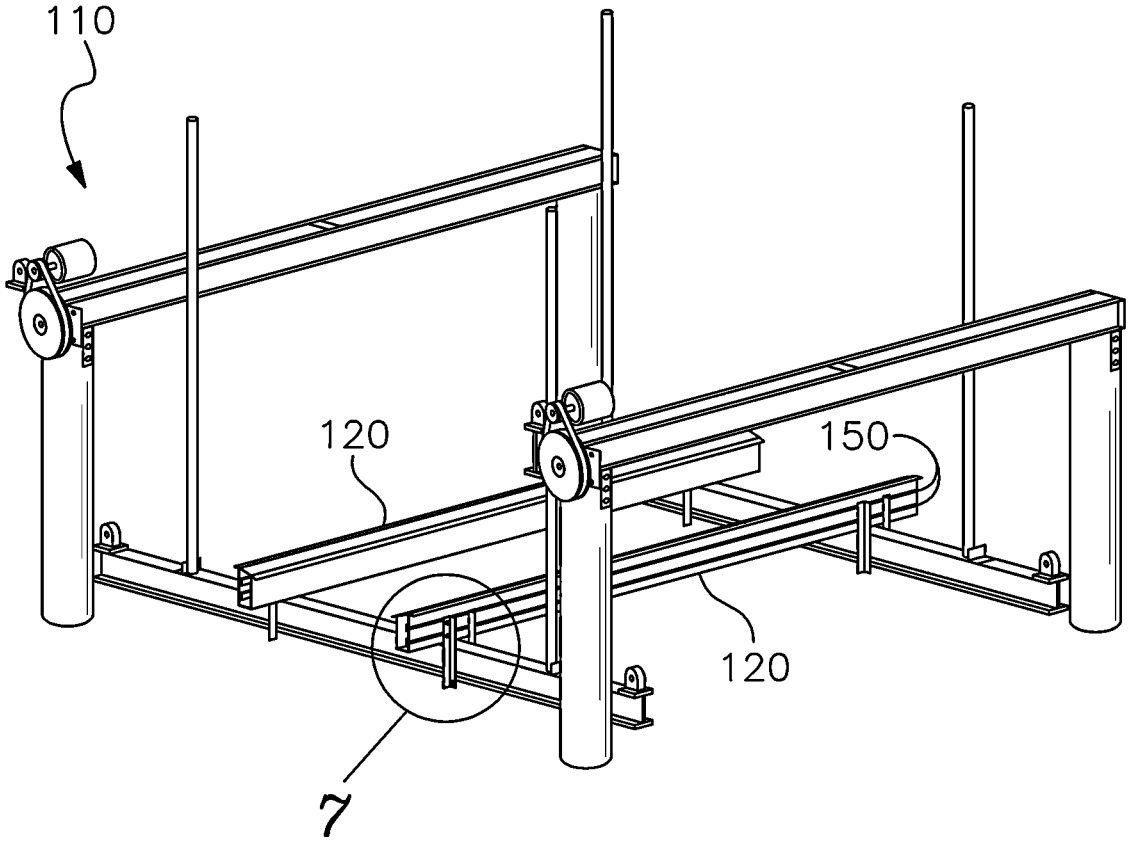
FIG. 6 is a perspective view of a cable driven boat lift employing a pair of vessel-supporting bunks constructed in accordance with this invention.

FIG. 6 depicts a boat lift 110 employing bunks 120 with longitudinal T-slots 150 as provided in this invention. Each of the bunks 120 employs the T-slot configuration disclosed herein. More specifically, a pair of generally parallel T-slots 150 are formed in the bunk in the first side wall 156 facing outwardly from the hull of the supported vessel (not shown). It should be understood that in alternative arrangements, the T-slots may be formed in the inwardly facing second side wall 158 of the bunk.

Figure 7:
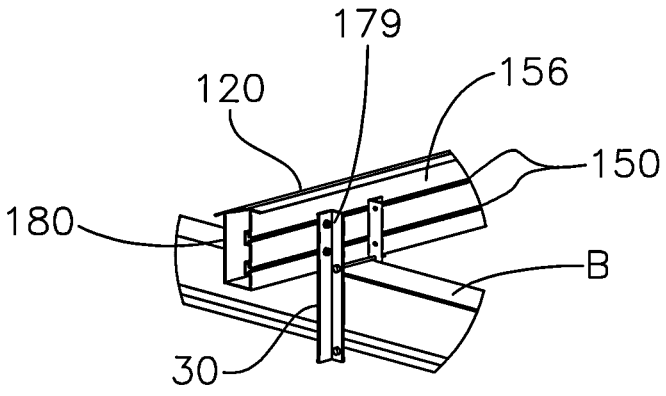
FIG. 7 is a fragmentary perspective view of the circled drawing portion designated by reference character 7 in FIG. 6, which reflects the improved bunk of this invention as connected to an underlying cradle beam.
Figure 8:
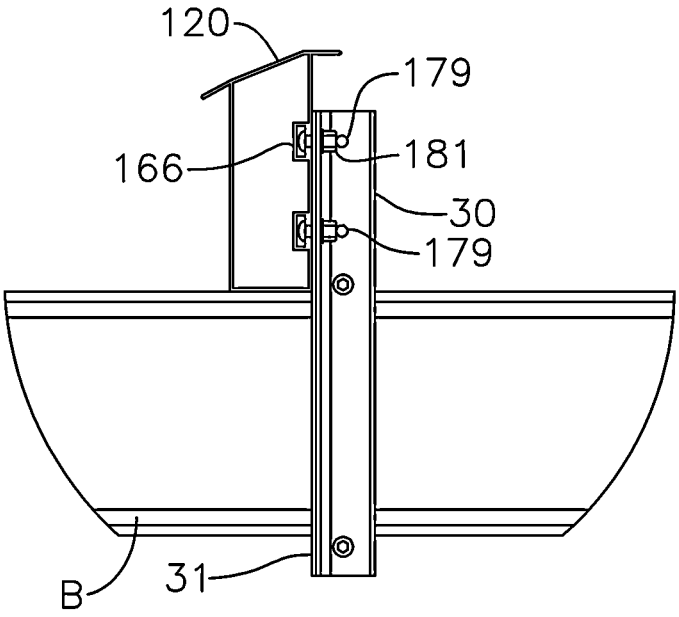
FIG. 8 is an elevational end view of the bunk of FIGS. 4-7 attached by a bunk bracket to a representative underlying cradle beam.

FIGS. 7 and 8 depict a preferred manner of mounting bunk 120 with integral T-slots 150 to a representative underlying cradle beam B. It should be understood that this construction and installation is the same or analogous to that for each other interconnection between bunk 120 and a respective cradle beam (i.e., proximate respective leading and trailing ends of each bunk and on both sides of each beam). Each bunk 120 is again mounted to a respective beam B by a pair of vertical L-shaped bunk brackets 30. The bunk brackets are secured to underlying cradle beam B in the manner previously described. According to the present invention, the bunk is alternatively secured to each of the bunk brackets 30 on respective opposing sides of the cradle beam in the following manner.

Bunk 120 is positioned across cradle B as shown in FIGS. 7 and 8. Instead of having to form two precisely aligned holes transversely though the bunk side walls in order to accommodate each connector bolt, the installer simply inserts a first pair of shorter carriage bolts 179 into the upper T-slot 150 and a second pair of carriage bolts 179 through the lower T-slot. The bolts in each slot are positioned on respective front and back sides of cradle beam B. In particular, the head of each bolt 179 is introduced at open end 180 (FIG. 7) of bunk 120 into the wide channel 166 of the T-slot (see FIGS. 4, 5 and 8). Carriage bolts 179 are much shorter than the bolts 36 employed to attach the bunk to the bunk bracket in the prior art. Specifically, the head of the bolt slides easily through its respective channel 166 and the threaded post of each bolt extends exteriorly of the bunk through the gap 164 of T-slot 150. Each bolt is quickly and conveniently slid through a respective upper or lower T-slot 150 and positioned to align with a corresponding connector hole in leg 31 of a respective bunk bracket 30. The threaded post of the connector bolt 179 is inserted through the corresponding hole in leg 31 of bracket 30. A fastening nut 181 is then threadably engaged with the threaded connector post and tightened to secure the bunk in place. The entry gap 164 and channel 166 are constructed such that the opposing lips 168 of each T-slot restrict the head of the bolt from being removed through the gap 164. Gap 164 is narrower than the head of bolt 179. Each bolt is therefore retained securely within the channel 166 of the T-slot. At the same time, the bolt is easily slidable longitudinally through the T-slot to quickly and conveniently position the bolt for alignment with and attachment to the corresponding connector hole of the associated bunk bracket. This eliminates the tedious and inconvenient procedure of measuring and cutting connector holes in the bunk required in the prior art. Each of the reduced-size carriage bolts are positioned and connected through a respective preformed bunk bracket connector hole in the foregoing manner. This secures the bunk at each end to a respective pair of bunk brackets and an underlying cradle beam. It should be understood that the interconnection shown in FIGS. 7 and 8 is likewise used to join bunk 120 to the bracket 30 attached to the opposite side of beam B, as well as wherever a bunk is mounted above an underlying cradle.

In other alternative versions, a single T-slot or other multiple numbers of T-slots may be employed in the bunk. Moreover, the T-slots may be formed in either side wall of the bunk and connections may be made at various other longitudinal positions along the bunks in accordance with this invention. The bunk may also be secured in a manner analogous to that described herein to alternative boat lift supporting structures including, but not limited to platforms and framework other than cradle beams. The disclosed structure represents a preferred manner of connecting the bunk to the underlying cradle beam in various boat lift structures and designs.

The bunk 120 with integral T-slots 150 achieves a number of benefits in accordance with this invention. Numerous connector holes do not have to be tediously and carefully measured and cut by the installer through opposing side walls of the bunk at both ends of the bunk. This facilitates the installation process considerably and reduces labor, installation costs, as well as potentially wasted materials, delays and added costs resulting from installation errors. The risk of collapsing the side walls of the bunk by over tightening the carriage bolts is virtually eliminated. The disclosed invention also allows the use of smaller and far less expensive, but equally effective connector bolts. Overall, the process of mounting bunks to an underlying boat lift structure is improved considerably. The installation operation is far simpler, less expensive and much more convenient and efficient than conventional installation techniques.

Accordingly, the present invention relates to an improved boat lift bunk having one or more integral T-slots for connecting to underlying cradle beams or other boat lift structure. While this detailed description has set forth particularly preferred embodiments of the apparatus of this invention, numerous modifications and variations of the structure of this invention, all within the scope of the invention, will readily occur to those skilled in the art.

Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

The invention claimed is:

1. A boat lift bunk for mounting to underlying supportive boat lift structure for supporting a marine vessel thereon, said bunk comprising:

an opposing pair of elongate top and bottom walls and an opposing pair of elongate first and second side walls interconnecting said top and bottom walls, said bottom wall being flat and extending laterally between respective lower ends of said first and second side walls, said top, bottom, first side and second side walls being movable longitudinally across the underlying supportive boat lift structure to a selected longitudinal position on the underlying supportive boat lift structure; said first side wall having a longitudinal T-slot formed therein for interengaging one or more connectors, each said connector being retained by and longitudinally slidable through said T-slot for selectively positioning each said connector to interengage and attach to the underlying supportive boat lift structure such that said one or more connectors secure said top, bottom, first side and second side walls of said bunk in the selected longitudinal position on the underlying supportive boat lift structure.

2. The device of claim 1 in which said first side wall includes a parallel pair of longitudinal T-slots for receiving and slidably retaining respective threaded connectors.

3. The device of claim 1 in which said T-slot includes an entry gap formed through said first side wall and a connector retaining channel attached interiorly to said first side wall.

4. The device of claim 3 in which said connector retaining channel is bounded by an interior channel wall that separates said retaining channel from an interior space of said bunk.

5. The device of claim 3 in which said retaining channel communicates with and is laterally wider than said entry gap of said T-slot.

6. A boat lift bunk for mounting to an underlying boat lift cradle beam to support a marine vessel thereon, said bunk comprising an opposing pair of elongate top and bottom walls and an opposing pair of elongate first and second side walls that interconnect said top and bottom walls to define an interior space of the bunk, said bottom wall being flat and extending laterally between respective lower ends of said first and second side walls for being supported above the underlying boat lift cradle beam; said top, bottom, first side and second side walls being movable longitudinally across the underlying boat lift cradle beam to a selected longitudinal position on the underlying boat lift cradle beam; said first side wall carrying a longitudinal T-slot for slidably interengaging a threaded connector, which threaded connector includes a head that is retained by and longitudinally slidable through said T-slot and a threaded post that extends from said head, through said T-slot and exteriorly of said first side wall of said bunk; said head of said connector being slid longitudinally through said T-slot to selectively position said threaded post for interengaging and attaching to the underlying boat lift cradle beam such that said connector secures said top, bottom, first side and second side walls of said bunk in the selected longitudinal position on the underlying cradle beam.

7. The device of claim 6 in which said first side wall carries a parallel pair of longitudinal T-slots, each said T-slot for receiving and slidably retaining a respective threaded connector.

8. The device of claim 6 in which said T-slot includes an entry gap formed through said first side wall and a connector retaining channel that is attached interiorly to said first side wall.

9. The device of claim 8 in which said connector retaining channel is bounded by an interior channel wall that separates said connector retaining channel from said interior space of the bunk.

10. The device of claim 8 in which said connector retaining channel communicates with and is laterally wider than said entry gap of said T-slot.

11. The device of claim 8 in which said bunk is further connected to the underlying cradle beam by a pair of vertical bunk brackets attached to opposite forward and rearward sides of the cradle beam.

12. The device of claim 11 in which said bunk includes a pair of longitudinal T-slots.

13. The device of claim 12 in which a pair of said threaded connectors are interengaged in each said T-slot and positioned on respective said forward and rearward sides of the underlying cradle beam.

14. The assembly of claim 13 in which each said bunk bracket includes a vertically oriented L-bracket having a first elongate vertical leg that interengages said first side wall of said bunk and respective said threaded connectors retained by said first side wall, and in which each said bunk bracket further includes a second elongate vertical leg attached perpendicularly to said first elongate vertical leg for interengaging a respective one of said forward and rearward sides of said cradle beam.

15. A boat lift bunk and cradle beam assembly for supporting a marine vessel thereon, said assembly comprising:

an elongate bunk including an opposing pair of longitudinal top and bottom walls and an opposing pair of longitudinal first and second side walls that interconnect said top and bottom walls to define an interior space of said bunk, said bottom wall extending laterally between, and interconnecting respective lower ends of said first and second side walls of said bunk;

an elongate cradle beam that extends laterally beneath and beyond said first and second side walls of said bunk, said cradle beam including a top surface, said bottom wall of said bunk being supported above said top surface of said cradle beam, said cradle beam also including forward and rearward vertical sides that depend from said top surface of said cradle beam; said top, bottom and side walls of said bunk being movable longitudinally across said top surface of said cradle beam to a selected longitudinal position on said cradle beam;

said first side wall of said bunk having a parallel pair of longitudinal T-slots interengaged by and retaining respective threaded connectors, said threaded connectors being longitudinally slidable through said T-slots; and said cradle beam carrying a pair of elongate, vertically oriented bunk brackets respectively supported on said forward and rearward sides of said cradle beam, said bunk brackets interengaging said first side wall of said bunk and said threaded connectors being slid through said T-slots and selectively positioned longitudinally in said bunk to interengage and attach to respective said bunk brackets such that said threaded connectors secure said top, bottom, first side and second side walls of said bunk in said selected longitudinal position on said underlying cradle beam.

16. The assembly of claim 15 in which a pair of said threaded connectors are installed in each said T-slot; one of said pair of threaded connectors being positioned forwardly of said underlying cradle beam and the other of said pair of threaded connectors being positioned rearwardly of said underlying cradle beam.

17. The assembly of claim 15 in which each said threaded connector includes a head retained in a respective said T-slot and a threaded post attached to said head and extending through said T-slot and exteriorly of said first side wall, said heads of said threaded connectors being slid longitudinally through respective said T-slots to selectively position said threaded posts for interengaging and attaching to respective said bunk brackets such that said threaded connectors secure said top, bottom, first side and second side walls of said bunk in the selected longitudinal position on the underlying cradle beam supporting said bunk brackets.

18. The assembly of claim 17 in which a respective nut is attached to each said threaded connector to secure said bunk to said vertical bunk brackets.

19. The assembly of claim 18 in which said bunk brackets include degree ninety L-brackets, each said L-bracket having an elongate first vertical leg that faces said first wall of said bunk and said T-slots formed in said bunk.

20. The assembly of claim 19 in which each bunk bracket further includes an elongate second vertical leg formed perpendicularly to said first vertical leg for facing and attaching to a respective one of said forward and rearward sides of said underlying cradle beam.

* * * * *